US006950002B2

(12) United States Patent
Sano

(10) Patent No.: US 6,950,002 B2
(45) Date of Patent: Sep. 27, 2005

(54) INDUCTANCE ELEMENT

(75) Inventor: Kan Sano, Katsushika-Ku (JP)

(73) Assignees: Sumida Corporation, Tokyo (JP); Sumida Electric Co., Ltd., Tokyo (JP)

( * ) Notice: Subject to any disclaimer, the term of this patent is extended or adjusted under 35 U.S.C. 154(b) by 0 days.

(21) Appl. No.: 10/988,010

(22) Filed: Nov. 12, 2004

(65) Prior Publication Data

US 2005/0104702 A1 May 19, 2005

(30) Foreign Application Priority Data

Nov. 13, 2003 (JP) ..... 2003-383621

(51) Int. Cl.[7] ..... H01F 27/02
(52) U.S. Cl. ..... 336/83; 336/65; 336/90
(58) Field of Search ..... 336/83, 65, 90, 336/84, 223, 232, 192, 212, 96

(56) References Cited

U.S. PATENT DOCUMENTS 6,753,749 B1 * 6/2004 Chin ..... 336/90

FOREIGN PATENT DOCUMENTS

JP 10012457 A * 1/1998
JP 11-054333 2/1999
JP 2002-313635 10/2002

* cited by examiner

*Primary Examiner*—Lincoln Donovan
*Assistant Examiner*—Jennifer A. Poker
(74) *Attorney, Agent, or Firm*—Stephen M. Chin; Reed Smith LLP

(57) ABSTRACT

An inductance element having a drum core around which a winding is to be wound and a ring core surrounding a circumference of the drum core, in which projections are provided either on an outer side surface of an upper flange section of the drum core or an inner side surface of the ring core, and recessions are provided in the other side surface to fit with the projections, each of the recession having an inclined plane inclining from the deepest part of the recession toward the outer edge on one side of the recession and having a bilaterally asymmetric cross-sectional shape with respect to a perpendicular line drawn from the deepest part to an opening of the recession viewing from the direction of an upper surface of the ring core.

6 Claims, 11 Drawing Sheets

INDUCTANCE ELEMENT

BACKGROUND OF THE INVENTION

1. Field of the Invention

The present invention relates to an inductance element used in general electronic devices or industrial electronic devices.

2. Description of the Related Art

FIG. 11 is a view showing an example constitution of a conventional inductance element. As shown in the view, an inductance element 1 is composed of a ring core 2, a drum core 6, and a coil 7.

The ring core 2 here is composed of a cylindrical magnetic member having a through hole 3 inside thereof. On upper portions of the ring core 2, connecting terminals 4, 5 with which tips of the coil 7 is to be connected are provided. Inside the through hole 3, the drum core 6 is disposed.

The drum core 6 is composed of an upper flange section 6*a*, a body section 6*b*, and a lower flange section 6*c*. The coil 7 is wound around the body section 6*b*.

In such an inductance element 1, favorable magnetic saturation characteristic is obtainable by leaking parts of magnetic flux outward through a gap G1 between the upper flange section 6*a* of the drum core 6 and the ring core 2 as well as a gap G2 between the lower flange section 6*c* of the drum core 6 and the ring core 2. However, if the gaps G1, G2 are excessively large, an absolute value of initial inductance lowers. Hence, it is required to place these gaps G1, G2 under a control and whether or not the gaps are assembled in compliance with design values has to be controlled accurately so that the inductance element 1 has an optimal inductance element value and a rated current value.

Therefore, for obtaining the gaps G1, G2 adequately, there are disclosed techniques as shown in Japanese Patent Application Laid-Open No. 2002-313635 (abstract, claims) (Patent document 1) and Japanese Patent Application Laid-Open No. Hei 11-54333 (abstract, claims) (Patent document 2).

The technique disclosed in Patent document 1 provides a projection on either an circumferential edge portion of an upper surface of a lower flange section or a bottom end surface of a ring core so that the projection comes into contact with the other surface to form a gap.

Meanwhile, the technique disclosed in Patent document 2 is composed of a square drum core having a base board with a step portion to fit with a case core and a flange at the other end to fit with the case core, and a square case core covering over the drum core such that a gap is provided between the step portion and the flange, in which small protruding parts serving as spacers are provided on the step portion and four outer side surfaces both of the flange, respectively, or otherwise on the step portion and four inner side surfaces facing the flange both of the case core, respectively.

Meanwhile, as a ring core and drum core, such a ferrite sintered compact with high magnetic permeability that is obtained by performing powder molding and then burning a metal oxide is used. Burning a ferrite causes shrinking of a member, so that a size control becomes difficult. On the back of this, in the technique disclosed in Patent documents 1, 2, the size control of the protruding part is difficult, therefore there are sometimes cases where a setting of a gap is not appropriate, or where a protruding part does not fit with a recession suitably in the worst case.

SUMMARY OF THE INVENTION

The present invention has been made in consideration of the above-mentioned circumstances, and an object thereof is to provide an inductance element whose size control is easy and element value can be set correctly.

In order to attain the above-mentioned object, the present invention is an inductance element that includes a drum core around which a wiring is to be wound and a ring core surrounding a circumference of the drum core, in which a projection is provided on either an outer side surface of an upper flange section of the drum core or an inner side surface of the ring core and a recession is provided in the other side surface to fit with the projection, and the recession includes an inclined plane inclining from a deepest part of the recession toward an outer edge on one side of the recession to have a bilaterally asymmetrical cross-sectional shape with respect to a perpendicular line drawn from the deepest part to an opening of the recession when viewing from a direction of an upper surface of the ring core.

On the back of this, the inductance element whose size control is easy and element value can be set correctly can be provided.

According to another aspect of the present invention, in addition to the above-described invention, the ring core has a cylindrical shape or a bottomed cylindrical cup shape. Therefore, the ring core can be manufactured easily.

According to still another aspect of the present invention, in addition to the above-described invention, the ring core has a rectangular cylindrical shape or a bottomed rectangular cylindrical cup shape. Therefore, the ring core can be manufactured easily.

Further, according to still another aspect of the present invention, in addition to the above-described invention, the projection has a hemispheric shape or a columnar shape. Therefore, by minimizing a contacting area with the recession, a variation in leakage amount of magnetic flux caused by variation in the contact area can be curbed.

Furthermore, according to still another aspect of the present invention, in addition to the above-described invention, the projections and the recessions are provided three pieces in number respectively and the recessions of a bilaterally asymmetric cross-sectional shape are arranged to be directed to a same direction with respect to a circumferential direction. Therefore, with minimum number of parts, a maximum effect can be achieved.

Moreover, according to still another aspect of the present invention, in addition to the above-described invention, said drum core further has a lower flange section, and a projection is provided on either an outer side surface of the lower flange section of said drum core or the inner side surface of said ring core and a recession is provided in the other surface to fit with the projection. Therefore, the gap can be kept to be constant not only at the upper flange section but also at the lower flange section without regard to its position, so that variations in the element can be kept to be minimum.

According to the present invention, it is possible to provide the inductance element whose size control is easy and element value can be set correctly.

BRIEF DESCRIPTION OF THE DRAWINGS

FIGS. 3A and 3B are views showing states of the drum core composing the inductance element shown in FIG. 1 when fixed to the ring core, in which FIG. 3A shows the state before fixing and FIG. 3B shows the state after fixing;

FIGS. 4A and 4B are enlarged views showing states of a projection and a recession shown in FIG. 3, in which FIG. 4A shows the state before fixing and FIG. 4B shows the state after fixing;

FIGS. 5A and 5B are views showing a state of the drum core composing the inductance element shown in FIG. 1 when fixed to the ring core, in which FIG. 5A is a view showing an upper surface in the fixed state and FIG. 5B is an view showing an under surface in the fixed state;

DETAILED DESCRIPTION OF THE PREFERRED EMBODIMENT

Hereinafter, one embodiment according to the present invention will be described with reference to the drawings.

Figure 1:
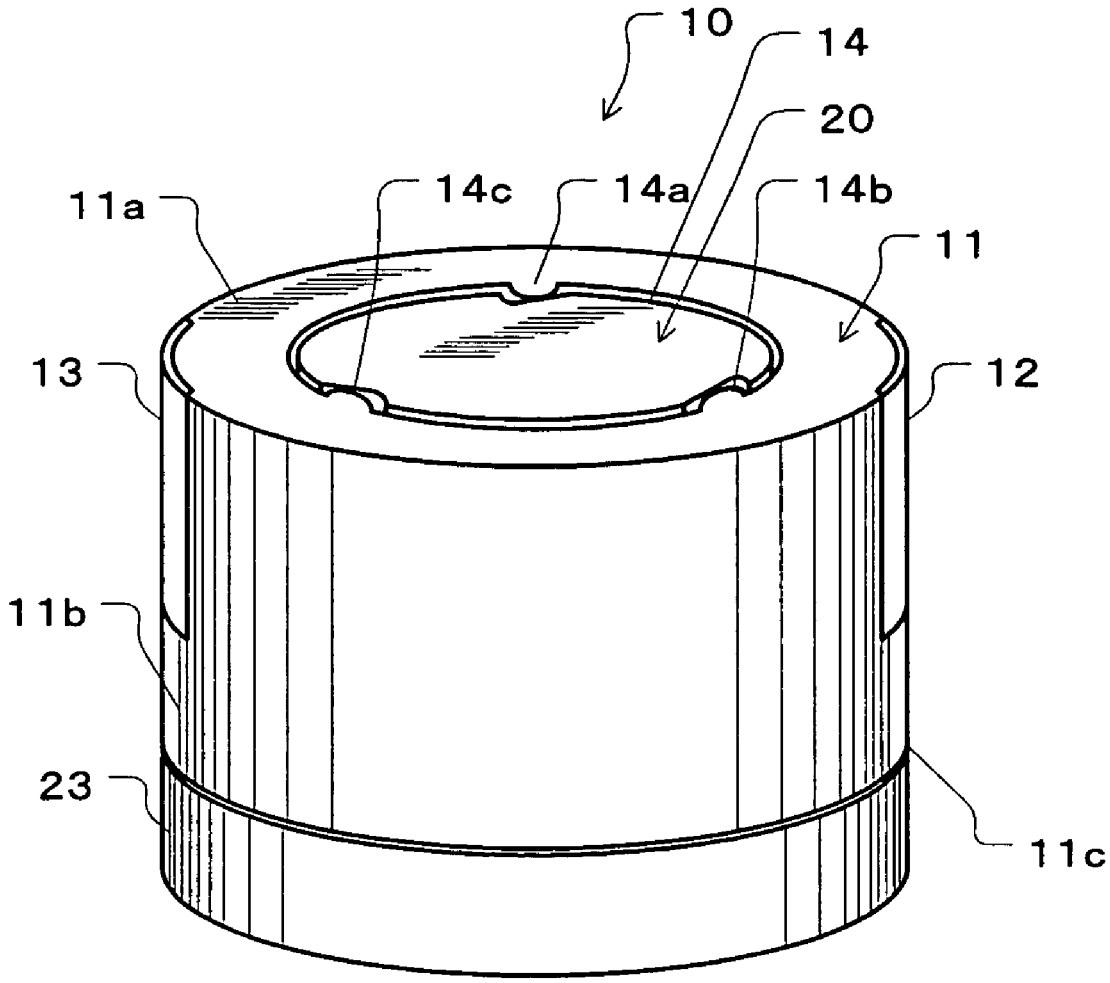
FIG. 1 is an external view showing an example constitution of an inductance element according to a first embodiment of the present invention.

FIG. 1 is an external view showing an example constitution of a first embodiment according to the present invention. As shown in the view, an inductance element 10 includes a ring core 11 having a cylindrical shape, and a drum core 20 disposed inside the ring core 11, as major components. The ring core 11 and the drum core 20, here, are formed from a ferrite sintered compact with high magnetic permeability that can be obtained by performing powder molding and then burning a metal oxide.

The ring core 11 having a cylindrical shape is provided with connecting terminals 12, 13 on a side surface 11*b* thereof for connecting to tips of an internal coil 30 (refer to FIG. 6), respectively. Additionally, between an upper surface 11*a* and an under surface 11*c*, there is formed a through hole 14 to connect the surfaces 11*a*, 11*c*, and a drum core 20, which will be described later, is disposed inside the through hole 14.

Figure 2:
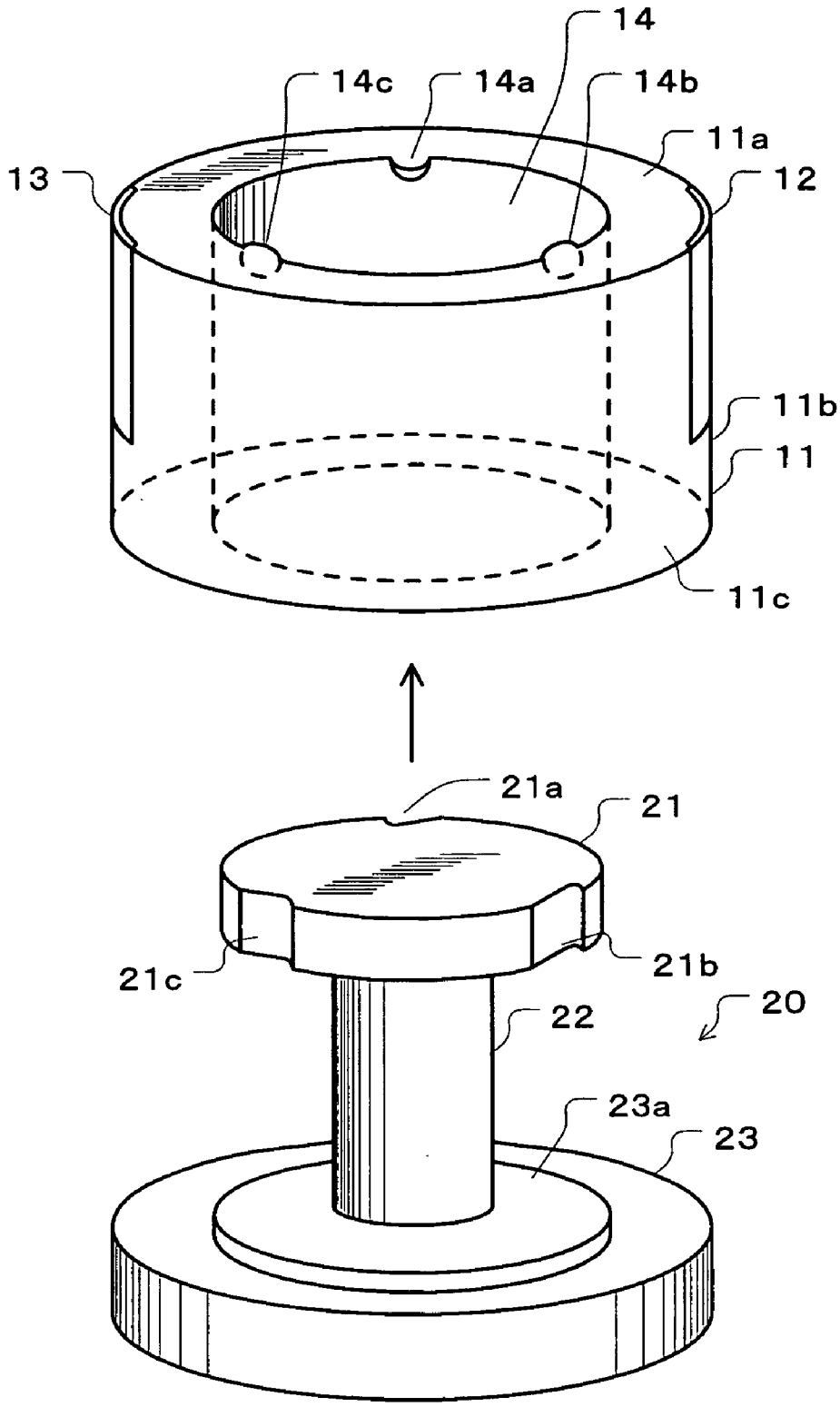
FIG. 2 is a view showing in detail the example constitution of a ring core and a drum core that compose the inductance element shown in FIG. 1.

FIG. 2 is an exploded view of the inductance element 10 shown in FIG. 1. As shown by a broken line in the view, the through hole 14 is provided inside the ring core 11. Inside the through hole 14, the drum core 20 is inserted from a bottom and fixed thereto.

The drum core 20 is composed mainly of an upper flange section 21, a body section 22, and a lower flange section 23 with a coil wound around the body section 22, although the coil is omitted in the view. On a side surface of the upper flange section 21, recessions 21*a* to 21*c* are provided at three positions to fit with projections 14*a* to 14*c* provided on an inner side surface of the through hole 14 of the ring core 11, respectively. At the center of the lower flange section 23, a projecting section 23*a* is provided to be inserted into and fitted with the through hole 14, enabling to prevent the drum core 20 from moving in the horizontal direction.

The drum core 20 is inserted into the through hole 14 of the ring core 11 upward from the bottom in the view and moved therethrough to the extent that the lower flange section 23 comes into contact with the under surface 11*c* of the ring core 11.

Figure 3A:
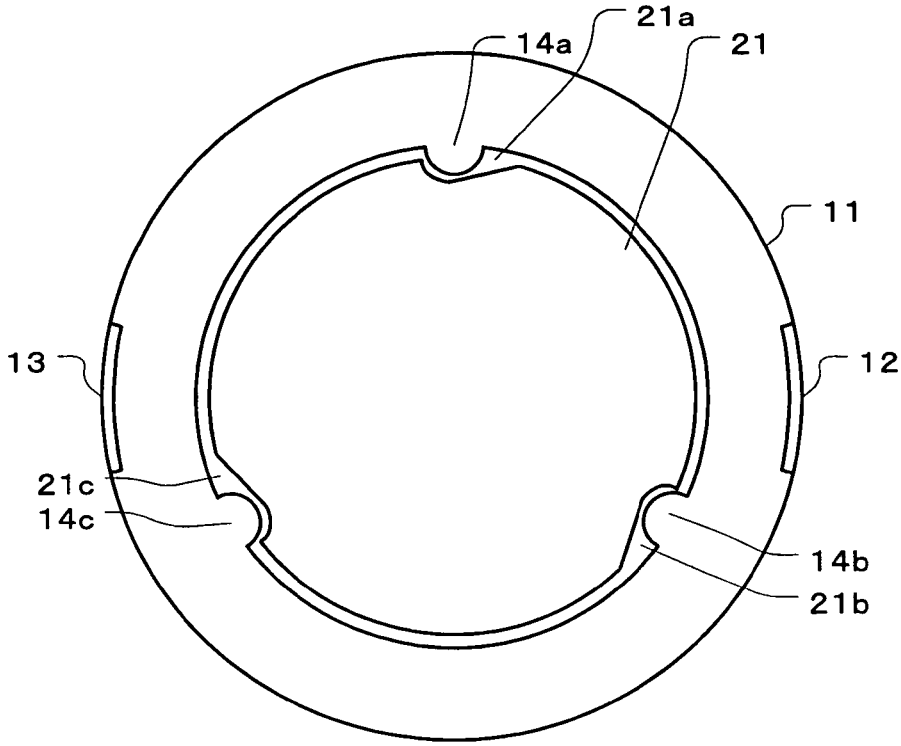
Figure 3B:
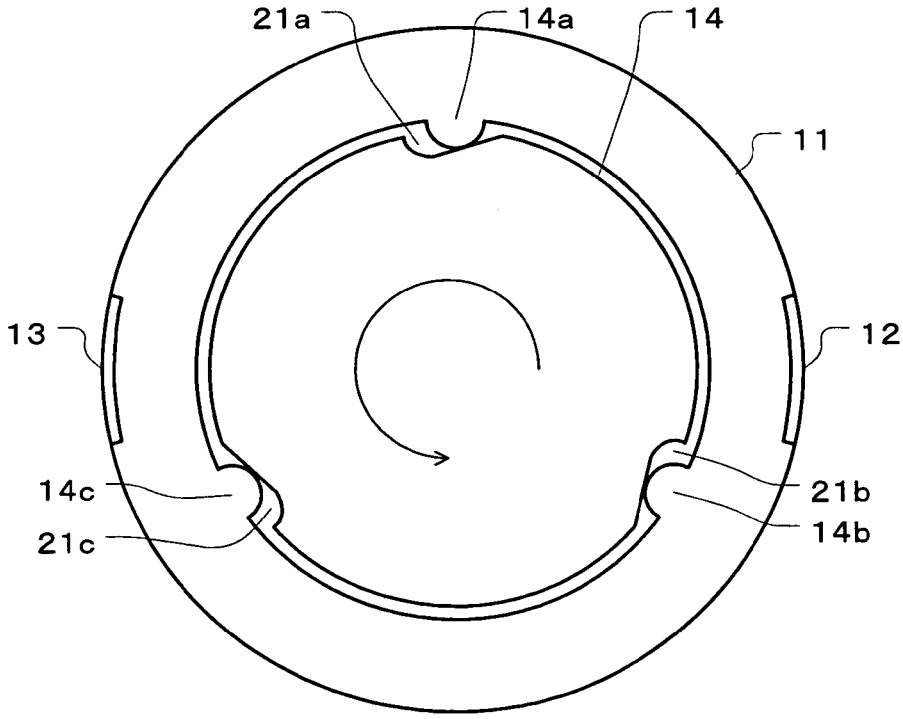

FIGS. 3A and 3B are views showing how the drum core 20 is fixed to the ring core 11. As shown in FIG. 3A, the drum core 20 is inserted into the through hole 14 of the ring core 11 while determining its position so that the projections 14*a* to 14*c* provided on the inner side surface of the through hole 14 of the ring core 11 are placed at the deepest parts of the recessions 21*a* to 21*c* provided in the outer side surface of the upper flange section 21 of the drum core 20.

Then, as shown in FIG. 3B, by rotating the lower flange section 23 of the drum core 20 counterclockwise (in the direction indicated by an arrow in the view) while holding the outer periphery of the ring core 11, the projections 14*a* to 14*c* are moved from the deepest parts of the recessions 21*a* to 21*c* and the tops thereof come into contact with certain positions on the inclined planes to be locked. At this time, with forces toward the center being applied by the projections 14*a* to 14*c* to the inclined planes, the drum core 20 is fixed in the horizontal direction.

Figure 4A:
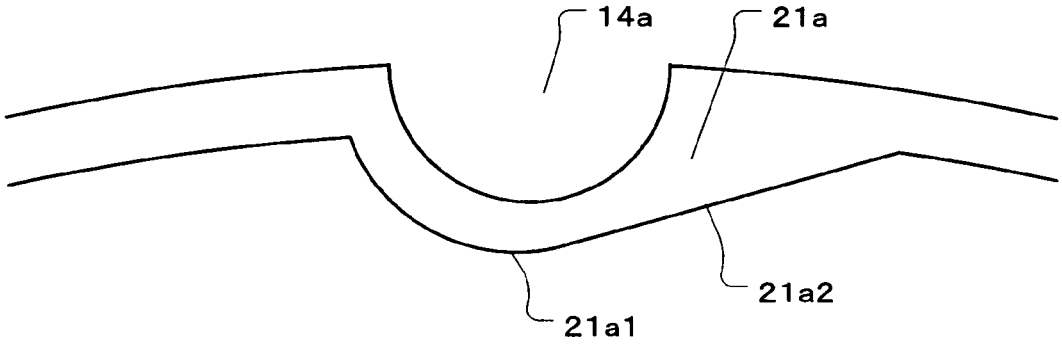
Figure 4B:
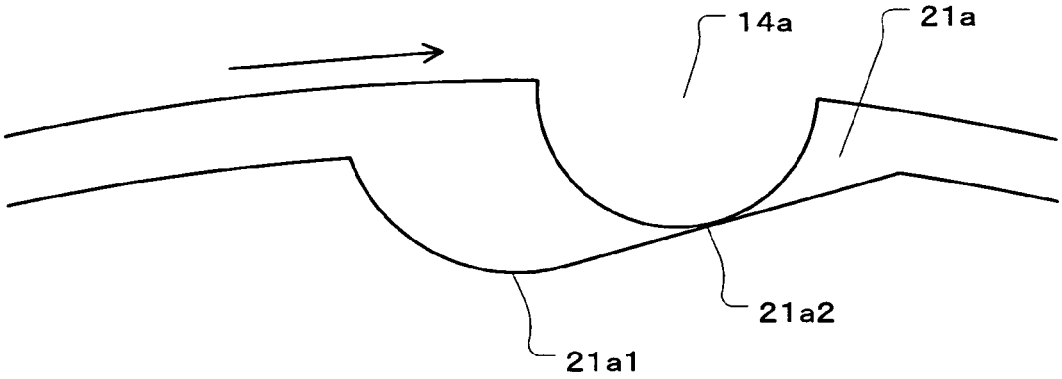

FIGS. 4A and 4B are enlarged views showing how the projection 14*a* fits with the recession 21*a*. As shown in FIG. 4A, the recession 21*a* has an inclined plane 21*a*2 slowly inclining from a deepest part 21*a*1 to an outer edge on one side of the recession, and has a bilaterally asymmetrical cross-sectional shape with respect to a perpendicular line drawn from the deepest part 21*a*1 to an opening of the recession 21*a* when viewing from a direction of an upper surface of the ring core 11.

When inserting the drum core 20 into the through hole 14 of the ring core 11, the drum core 20 is inserted while being determined its position so that the projection 14*a* thereof is positioned at the deepest part 21*a*1 of the recession 21*a*. When the drum core 20 is inserted to the extent that the lower flange section 23 thereof comes into contact with the under surface 11*c* of the ring core 11, then the drum core 20 and the ring core 11 are rotated to move in the direction of an arrow in FIG. 4B. As a result, as shown in FIG. 4B, the projection 14*a* is locked at a certain position on the inclined plane 21*a*2. The respective inclined planes of the recessions 21*b*, 21*c* corresponding to the inclined plane 21*a*2 are provided in the same circumferential direction of the drum core 20. Accordingly, when the drum core 20 is rotated in the ring core 11 in the direction of the arrow in FIG. 4B, the projections 14*b*, 14*c* and the recessions 21*b*, 21*c* are fixed in the same manner.

Figure 5A:
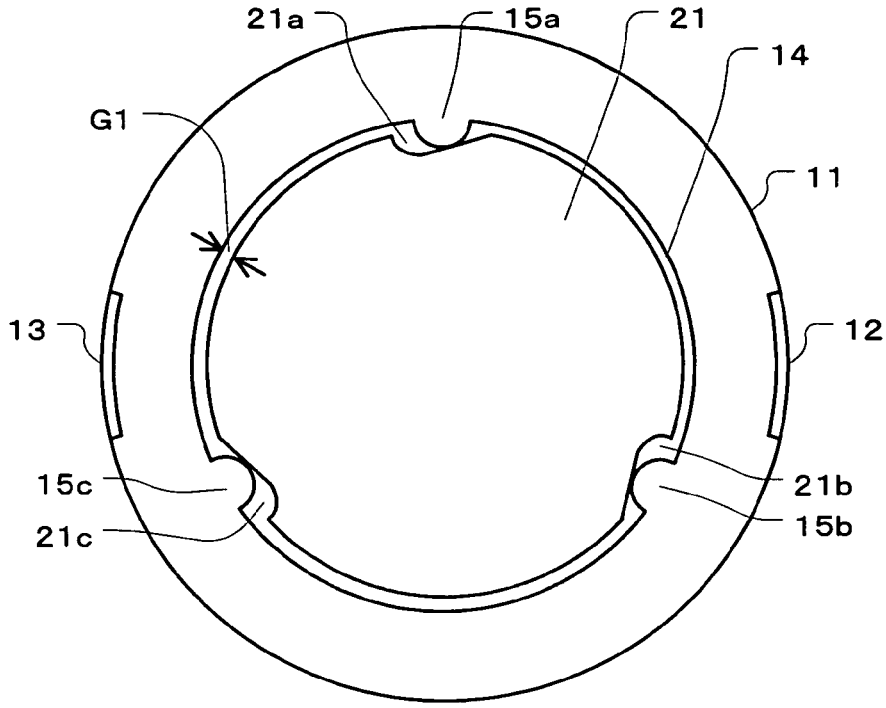
Figure 5B:
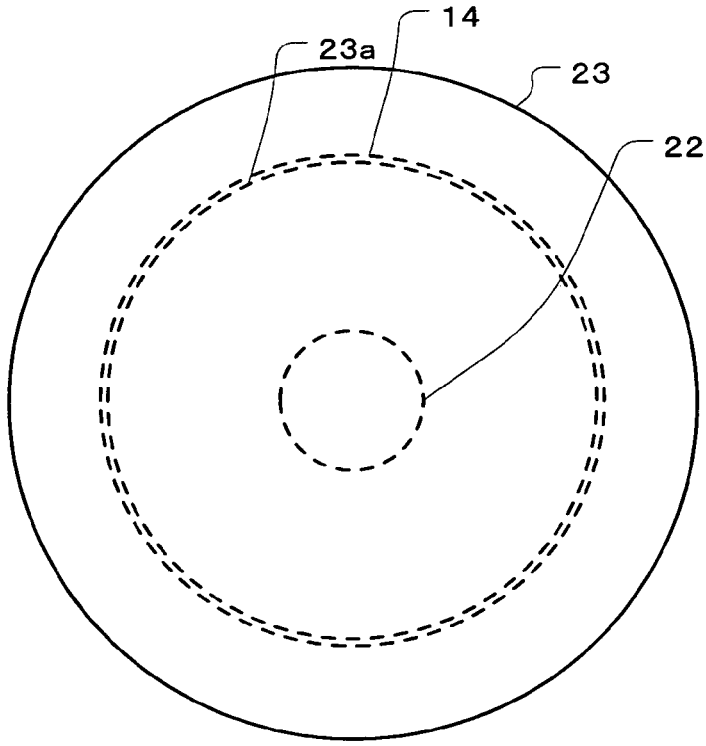

FIGS. 5A and 5B are plan views showing a state of the drum core 20 that is fixed to the ring core 11 when viewing from the top surface and the bottom surface, respectively. FIG. 5A is a plan view of the inductance element 10 viewing from the top surface. As shown in the view, the drum core 20 is held by the projections 14*a* to 14*c* provided on the inner side surface of the through hole 14 of the ring core 11, where a gap G1 between the outer side surface of the upper flange section 21 and the inner side surface of the through hole 14 is kept to be constant in any position thereof. Thus, since the gap G1 is kept to be constant without regard to its positions, magnetic flux leakage comes to be constant at any position, so that variation in an element value can be reduced.

Incidentally, an appropriate setting of the gap G1 in the design step allows a correct adjustment of the element value.

FIG. 5B is a view showing the inductance element 10 when viewing from the bottom surface. As shown by a broken line in the view, the projecting section 23*a* is inserted into inside the through hole 14 to be fixed. Further, the body section 22 is adjusted to position at the center portion of the through hole 14.

Figure 6:
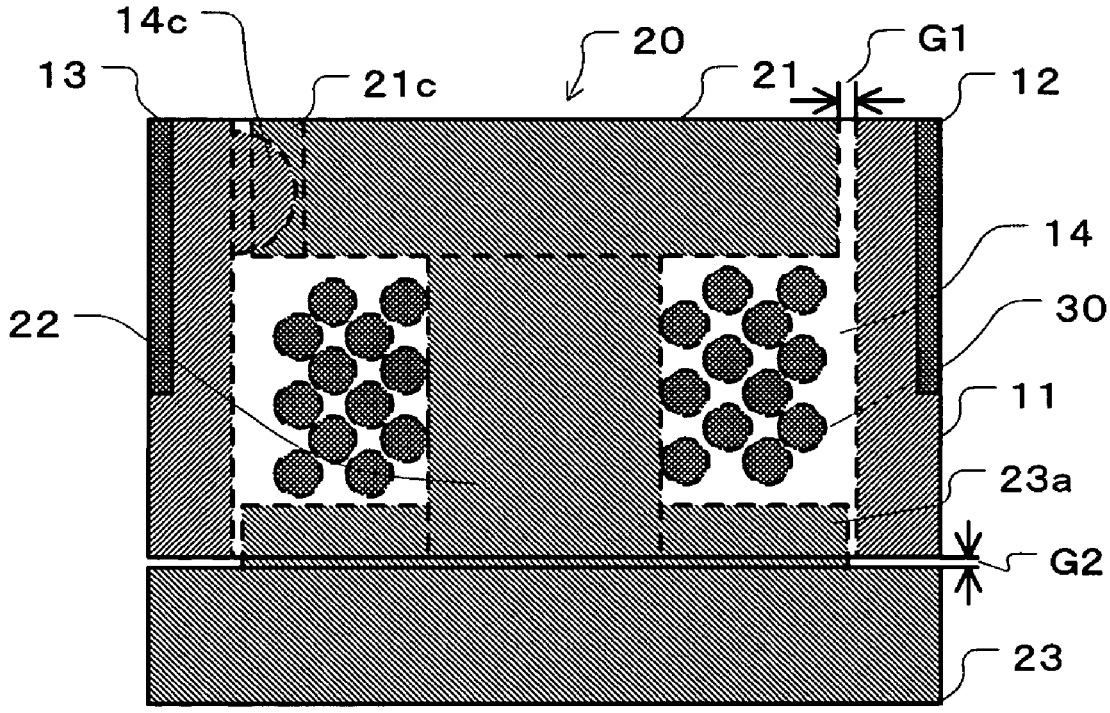
FIG. 6 is a cross sectional view showing the state of the drum core composing the inductance element shown in FIG. 1 when fixed to the ring core.

FIG. 6 is a front view showing the state of the drum core 20 that is fixed. As shown in the view, the recession 21*c* provided in the outer side surface of the upper flange section 21 of the drum core 20 fits with the projection 14*c* provided on the inner side surface of the through hole 14 to thereby hold the gap G1 between the side surface of the upper flange section 21 and the inner side surface of the through hole 14 to be constant. Further, the projecting section 23*a* is inserted into the through hole 14 to hold a gap G2 between the upper surface of the lower flange section 23 and the under surface 11*c* of the ring core 11 to be constant. Here, a relation G2<G1 is satisfied in general.

As has been described in the above, according to the first embodiment of the present invention, there are provided the projections 14*a* to 14*c* on the inner side surface of the ring core 11, and the recessions 21*a* to 21*c* in the outer side surface of the upper flange section 21 of the drum core 20, and by engaging them with each other, the drum core 20 is designed to be fixed to the inside of the ring core 11, so that the gap G1 can be kept to be constant in any position thereof. Accordingly, it is possible to prevent variation in the element value from arising.

Further, in the first embodiment, the projections 14*a* to 14*c* having a hemispheric shape are employed, thereby contact area of the ring core 11 and drum core 20 is minimized, so that variation in the element value caused by fluctuations in the contact area can be prevented.

Furthermore, in the first embodiment, the inclined plane 21*a*2 is provided to fix the projection 14*a* thereto, so that the drum core 20 can be fixed to the ring core 11 surely even if size accuracy is low level.

Next, a second embodiment of the present invention will be described.

Figure 7:
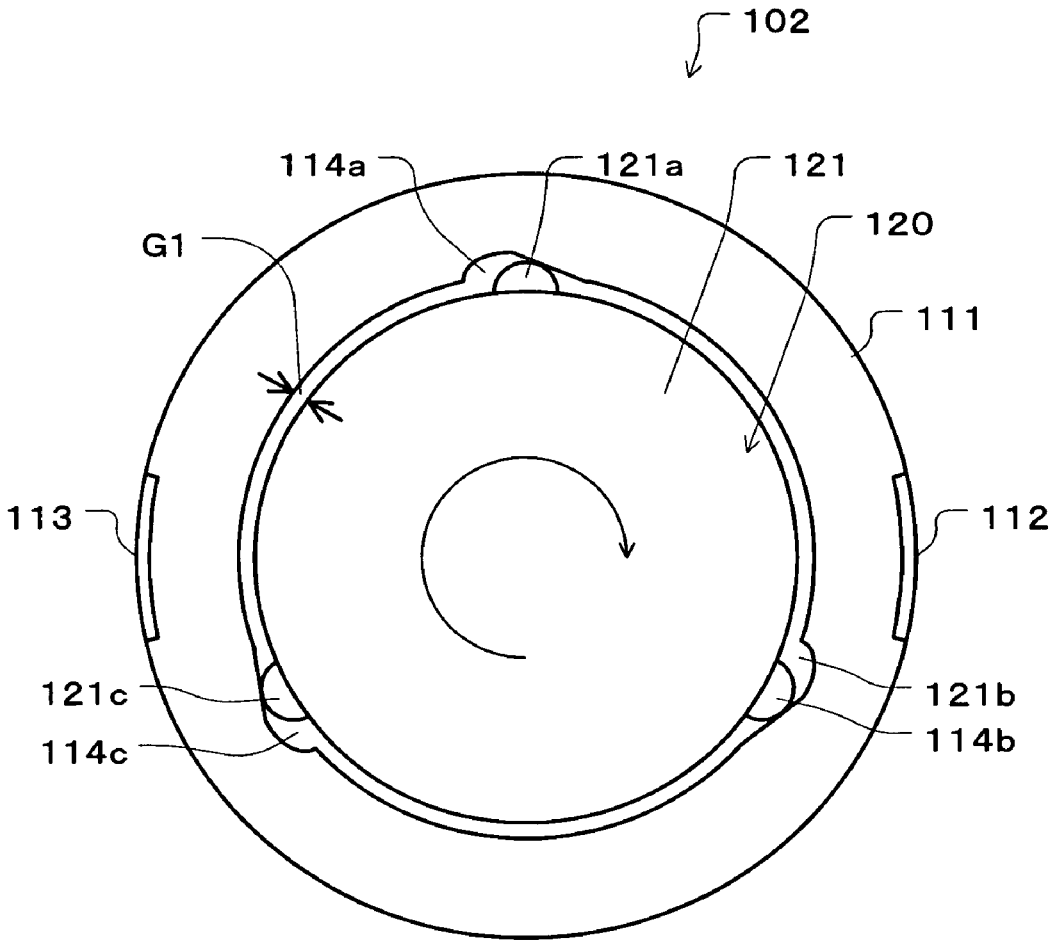
FIG. 7 is an external view showing an example constitution of an inductance element according to a second embodiment of the present invention.
Figure 8:
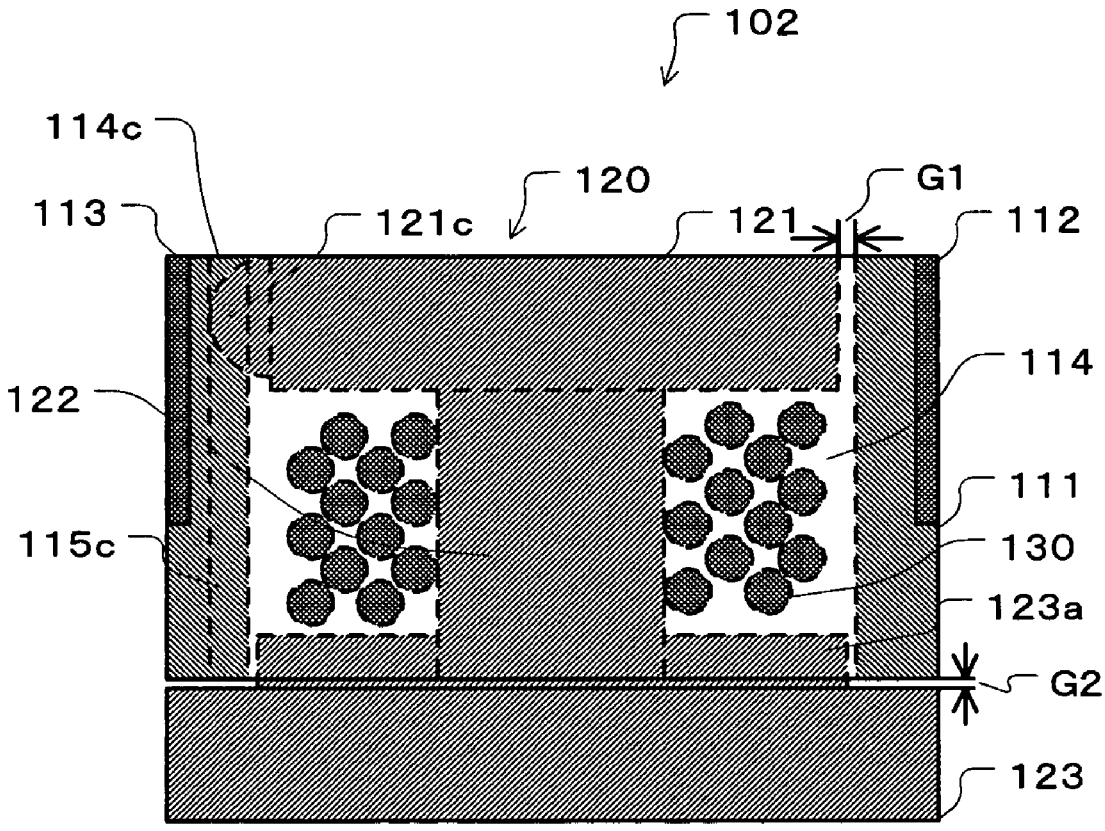
FIG. 8 is a cross sectional view showing a cross-sectional state of the inductance element shown in FIG. 7.

FIG. 7 is a view showing an example constitution according to the second embodiment of the present invention. In this embodiment, there are provided projections 121*a* to 121*c* on an outer side surface of an upper flange section 121, and recessions 114*a* to 114*c* in an inner side surface of a through hole 114, respectively. Further, as shown in FIG. 8, deepest parts of the recessions 114*a* to 114*c* are formed as grooves 115*c* extending to the other side of the inner side surface of the through hole 114.

In the case of assembling an inductance element 102 according to the second embodiment of the present invention, the projection 121*c* is inserted along the groove 115*c*, and when the upper surface of a drum core 120 reaches to the upper end of the through hole 114, by rotating the drum core 120 clockwise as shown by an arrow in FIG. 7, the projections 121*a* to 121*c* move from the deepest parts of the recessions 114*a* to 114*c* toward a slowly inclining plane side, and when they reach to certain positions, then the projections 121*a* to 121*c* are locked by the slowly inclining plane.

Also, in the case of such an embodiment, it is possible to keep a gap G1 between the drum core 120 and the ring core 111 to be constant without regard to its positions, so that variation in the element value can be prevented.

Further, in the case of the second embodiment, what required to do when inserting the drum core 120 into the ring core 111 is only to insert the projections 121*a* to 121*c* along the grooves 115*c*, eliminating the positioning of the drum core 20 after it is inserted into the through hole 14 as in the first embodiment, so that the assembling work is facilitated.

Subsequently, a third embodiment of the present invention will be described.

Figure 9:
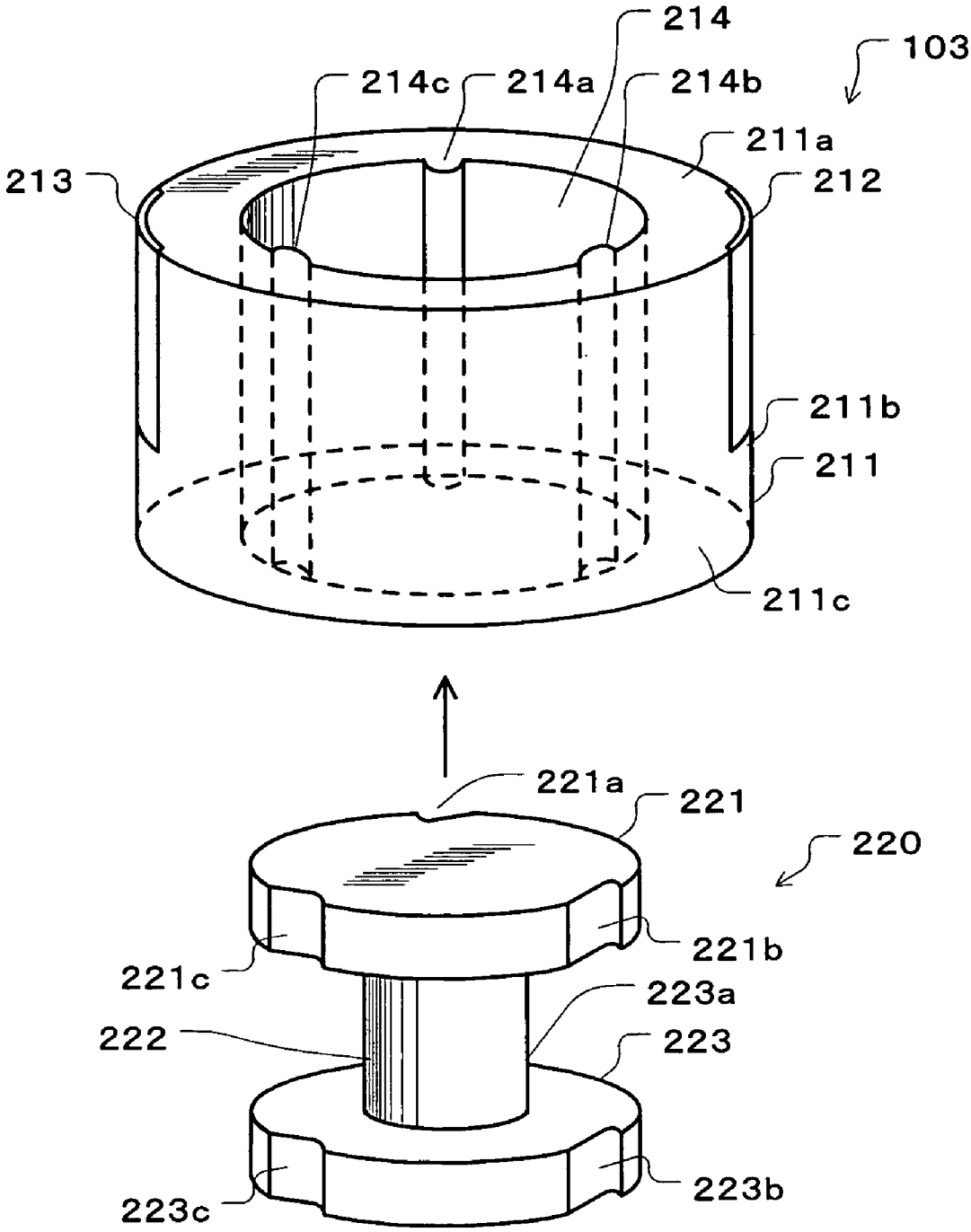
FIG. 9 is an external view showing an example constitution of an inductance element according to a third embodiment of the present invention.

FIG. 9 is a view showing an example constitution according to the third embodiment of the present invention. In the example shown in the view, projections 214*a* to 214*c* of a semicylindrical shape are newly provided in a through hole 214 of a ring core 211, and a lower flange section 223 of a drum core 220 has the same shape as of an upper flange section 221 of the drum core 220.

When assembling such an inductance element 103, first, the drum core 220 is inserted into the inside of a through hole 214 from a bottom side or a top side of a ring core 211. Next, similarly to the case shown in FIG. 3A, by rotating the drum core 220 counterclockwise, recessions 221*a* to 221*c* are fitted with upper edge portions of the projections 214*a* to 214*c* and recessions 223*a* to 223*c* are fitted with lower edge portions of the projections 214*a* to 214*c* in the same manner, so that the drum core 220 is locked at the ring core 211.

In the case of this embodiment, a gap can be kept to be constant not only at the upper flange section 221 but also at the lower flange section 223 in any position thereof, so that variations in the element value can be reduced further.

Subsequently, a fourth embodiment of the present invention will be described.

Figure 10:
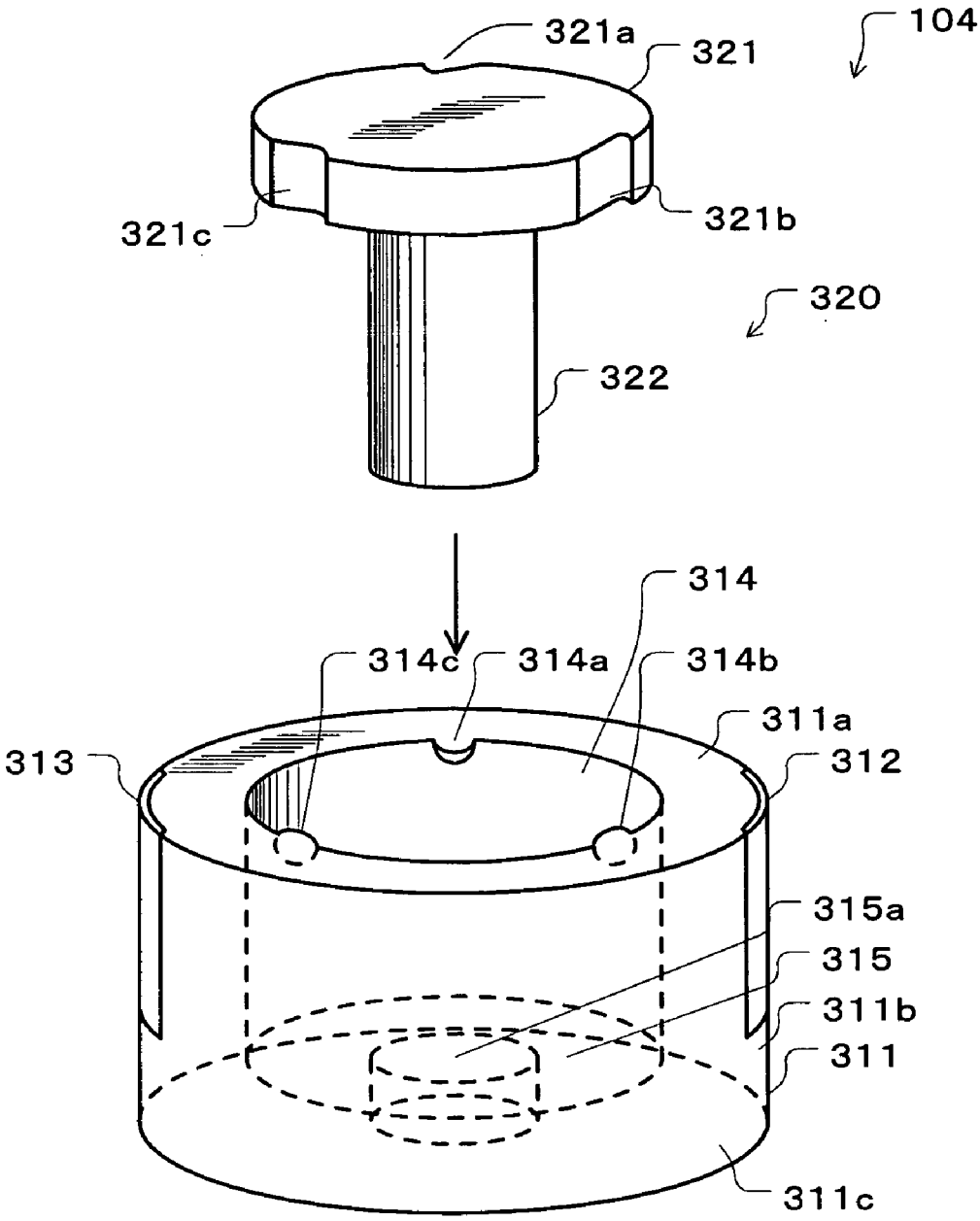
FIG. 10 is an external view showing an example constitution of an inductance element according to a fourth embodiment of the present invention.
Figure 11:
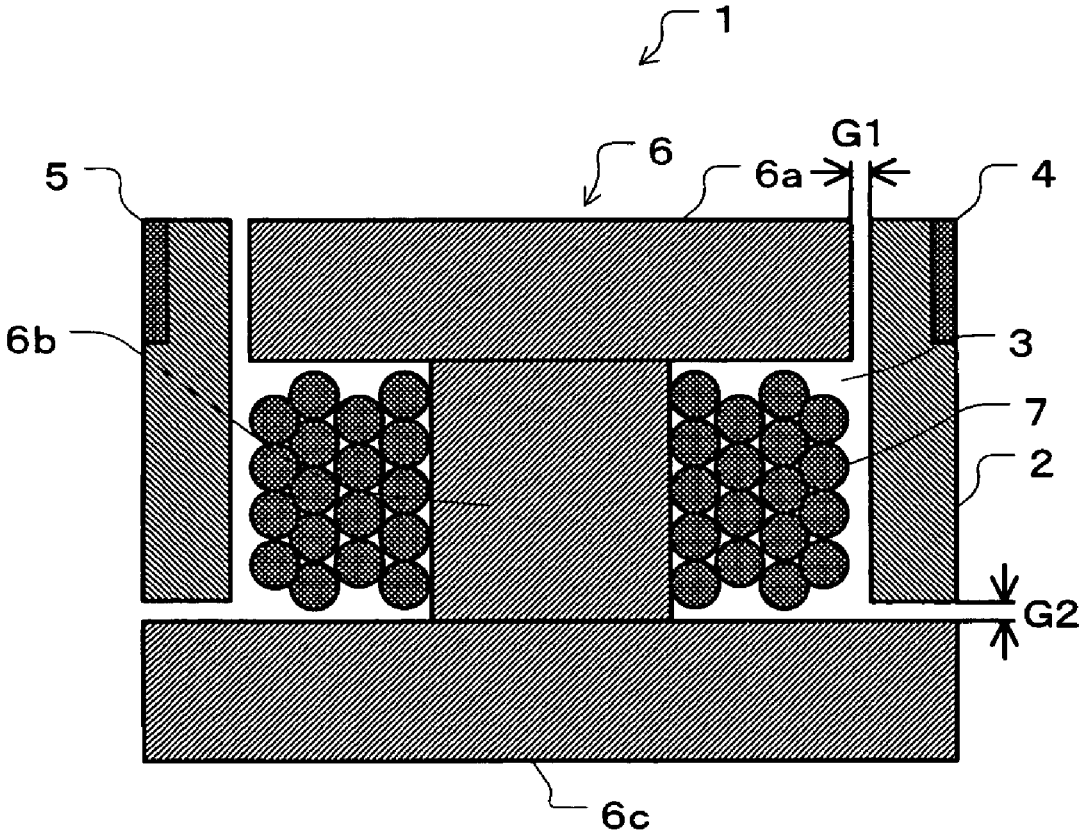
FIG. 11 is a sectional view showing a cross-sectional state of a conventional inductance element.

FIG. 10 is a view showing an example constitution according to the fourth embodiment of the present invention. In the example shown in the view, a drum core 320 is constituted without having a lower flange section. Meanwhile, a ring core 311 is constituted to have a bottom 315 with an insertion hole 315*a* at the center thereof for inserting a lower end of a body section 322 of the drum core 320 thereinto.

In this embodiment, the drum core 320 is inserted into a through hole 314 from the top side of the ring core 311, and the body section 322 is inserted into the through hole 315*a*, and, similarly to the case shown in FIG. 3A, by rotating the drum core 320 counterclockwise, recessions 321*a* to 321*c* and projections 314*a* to 314*c* are fitted with each other to be locked.

According to such an embodiment, similarly to the cases of the above-described respective embodiments, variation in the element value can be prevented from arising.

Incidentally, in the above-described embodiments, as a ring core, those having a cylindrical shape are presented as examples, whereas that having a rectangular shape can also be used.

Further, in the above-described embodiments, the projections 14*a* to 14*c*, 114*a* to 114*c*, 214*a* to 214*c*, and 314*a* to 314*c* are described as those having a hemispheric shape as examples, whereas that having the other shape can also be used. For instance, as a projection, that having a columnar shape can also be used. In addition, a plurality of projections can be provided along the depth direction of the through hole 14. According to such an embodiment, stability can be improved.

Furthermore, in the above-described embodiments, the projections 14*a* to 14*c*, 114*a* to 114*c*, 214*a* to 214*c*, and 314*a* to 314*c* are provided three pieces in number for each ring core or drum core, whereas the number of pieces may be one, two, four, or more.

The present invention is applicable for an inductance element having a drum core around which a winding is to be wound, and a ring core surrounding a circumference of the drum core.

What is claimed is:

1. An inductance element having a drum core around which a wiring is to be wound and a ring core surrounding a circumference of said drum core, wherein a projection is provided on either an outer side surface of an upper flange section of said drum core or an inner side surface of said ring core and a recession is provided in the other surface to fit with the projection, and wherein the recession includes an inclined plane inclining from a deepest part of the recession toward an outer edge on one side of the recession to have a bilaterally asymmetrical cross-sectional shape with respect to a perpendicular line drawn from the deepest part to an opening of the recession when viewing from a direction of an upper surface of said ring core.

2. The inductance element according to claim 1, wherein said ring core has a cylindrical shape or a bottomed cylindrical cup shape.

3. The inductance element according to claim 1, wherein said ring core has a rectangular cylindrical shape or a bottomed rectangular cylindrical cup shape.

4. The inductance element according to claim 1, wherein the projection has a hemispheric shape or a columnar shape.

5. The inductance element according to claim 1, wherein the projections and the recessions are provided three pieces in number respectively and the recessions of the bilaterally asymmetric cross-sectional shape are arranged to be directed to a same direction with respect to a circumferential direction.

6. The inductance element according to claim 1, wherein said drum core further has a lower flange section, and wherein a projection is provided on either an outer side surface of the lower flange section of said drum core or the inner side surface of said ring core and a recession is provided in the other surface to fit with the projection.

* * * * *